US007398965B2

(12) United States Patent
Glaser et al.

(10) Patent No.: US 7,398,965 B2
(45) Date of Patent: Jul. 15, 2008

(54) HOLDER FOR SUPPORTING WORKPIECE IN A FIXED LOCATION PIVOTAL ABOUT DUAL AXES

(75) Inventors: Donald J. Glaser, Emporia, KS (US); Lon C. Tidwell, Emporia, KS (US)

(73) Assignee: Glendo Corporation, Emporia, KS (US)

( * ) Notice: Subject to any disclaimer, the term of this patent is extended or adjusted under 35 U.S.C. 154(b) by 0 days.

(21) Appl. No.: 11/164,012

(22) Filed: Nov. 7, 2005

(65) Prior Publication Data

US 2006/0038334 A1 Feb. 23, 2006

Related U.S. Application Data

(63) Continuation of application No. 10/604,659, filed on Aug. 7, 2003, now Pat. No. 6,978,989.

(51) Int. Cl.
*B22B 1/22* (2006.01)

(52) U.S. Cl. ..... 269/71; 269/3; 269/6

(58) Field of Classification Search ..... 269/71, 269/3, 6, 95, 101

See application file for complete search history.

(56) References Cited

U.S. PATENT DOCUMENTS 4,744,552 A * 5/1988 Glaser ..... 269/71
6,648,318 B1 * 11/2003 Oetlinger et al. ..... 269/41
6,978,989 B2 * 12/2005 Glaser et al. ..... 269/71

* cited by examiner

*Primary Examiner*—Lee D Wilson
(74) *Attorney, Agent, or Firm*—Hovey Williams LLP

(57) ABSTRACT

A workpiece holding system (10) is configured for holding a workpiece (R) for crafting thereof by a craftsman (C). The system (10) broadly includes a mounting assembly (12) removably coupled a support surface (B), an articulating frame assembly (14) coupled to the mounting assembly (12), a workpiece-supporting tool assembly (16) removably coupled to the frame assembly (14), and a mirrored ambidextrous handrest assembly (18) removably coupled to the mounting assembly (12). A fixture (36) spaced from a work zone (W) adjustably receives the tool assembly (16) so that the workpiece (R) held therein can be positioned substantially in the work zone (W) so that when the tool assembly (16) is maneuvered, thereby articulating the frame assembly (14), the workpiece (R) substantially remains in the work zone (W). The tool assembly (16) includes a connection assembly (80) configured to quickly and removably couple tools (78, 140, 152, 154, 172) into a clamp (76).

18 Claims, 5 Drawing Sheets

B
30
192
190
24
180
32a
38
42
186
32
78
64
62
116
178
178b
34a
R
68
76
36
16
22
34
32b
40
22
192
180
178
178b
186
36
68
78
42
38
R
32
24
64
62
76
16
116
34a
34
32b
40
42

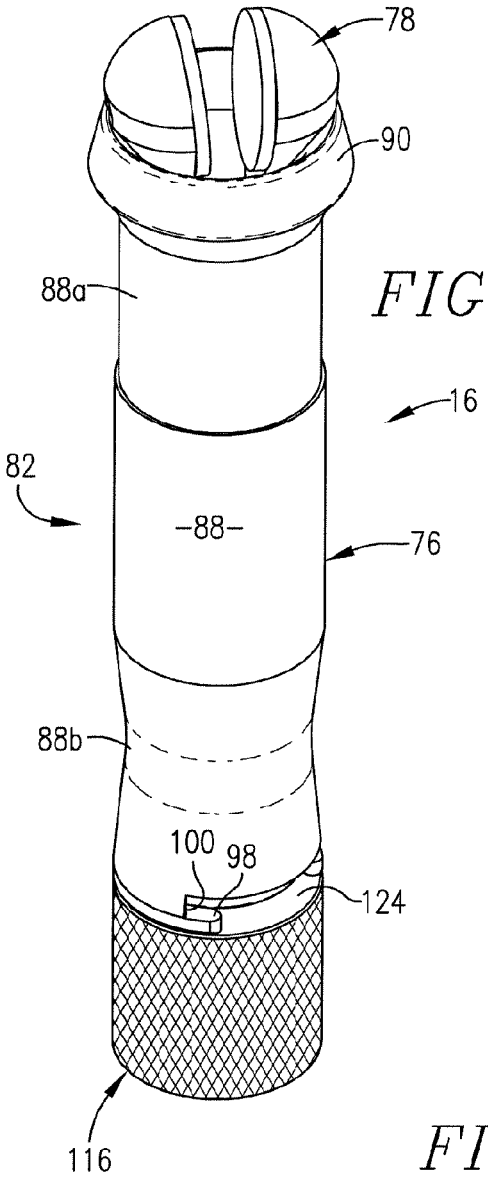
FIG. 9.
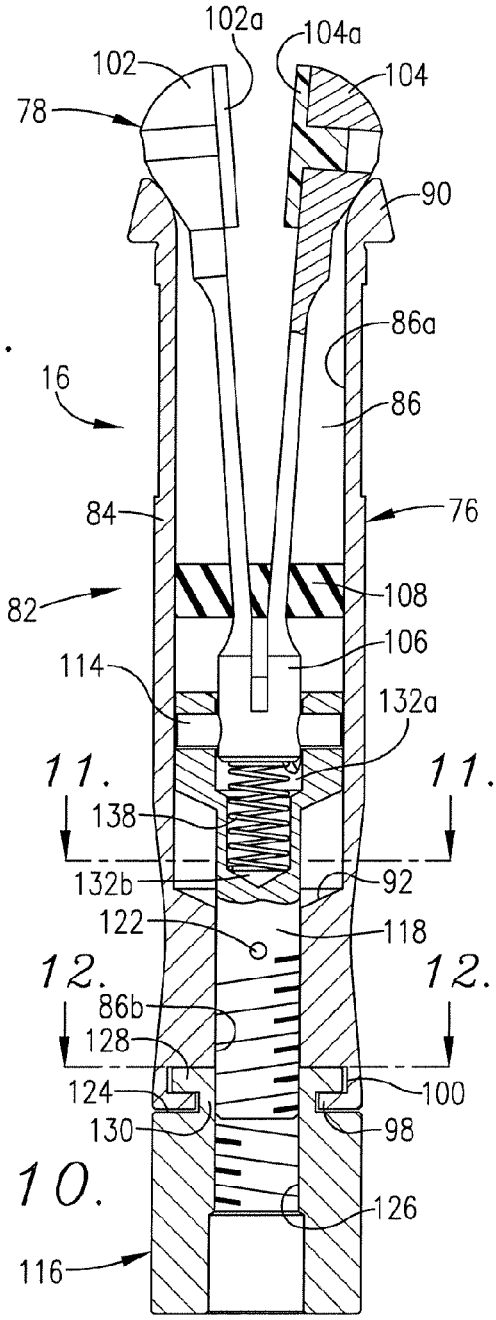
FIG. 10.
FIG. 11.
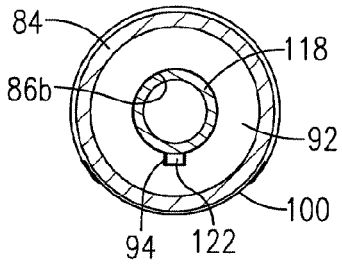
FIG. 12.
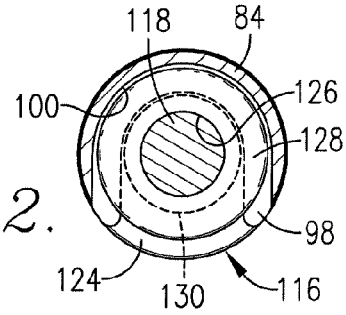

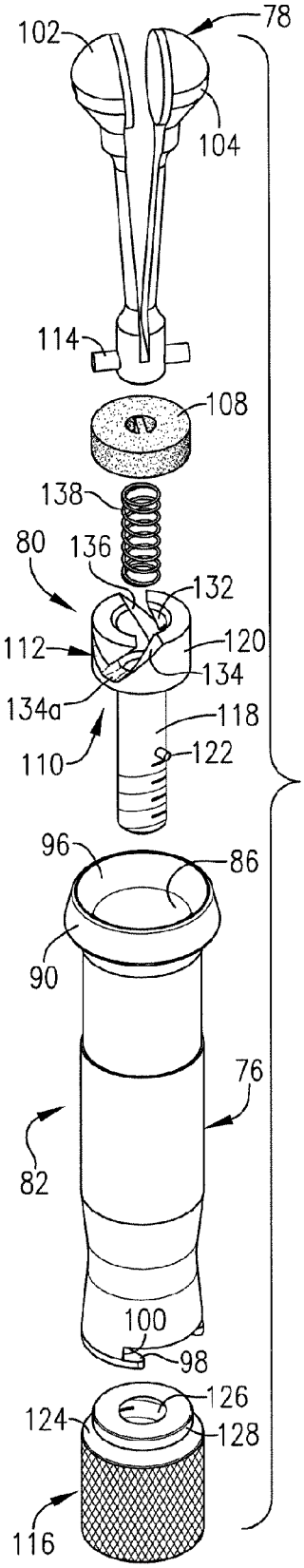
FIG. 13.
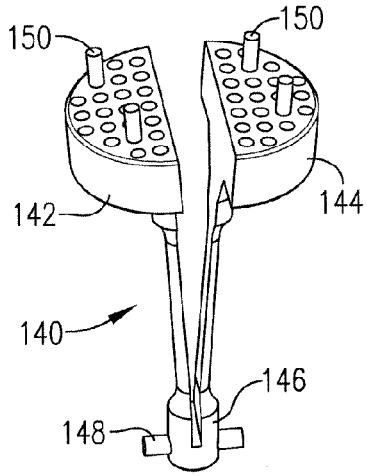
FIG. 14.
FIG. 15.
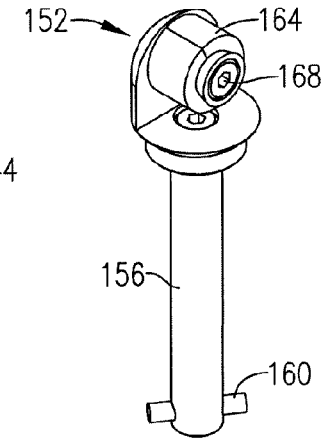
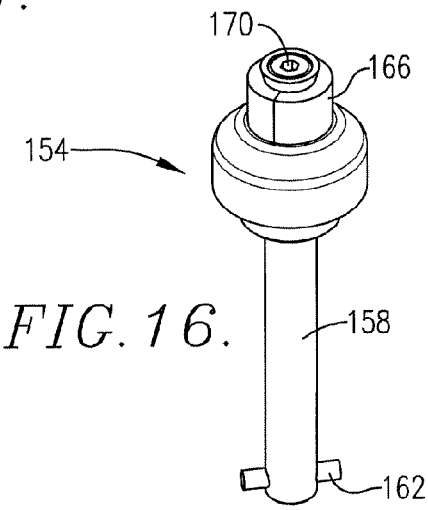
FIG. 16.
FIG. 18.
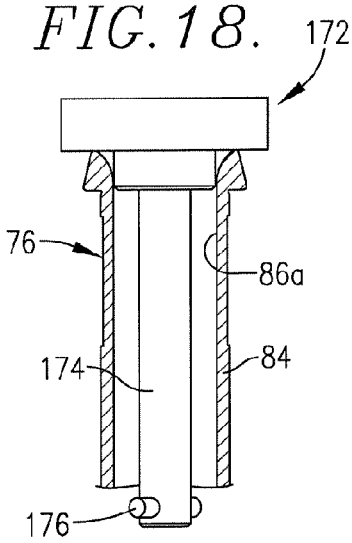
FIG. 17.
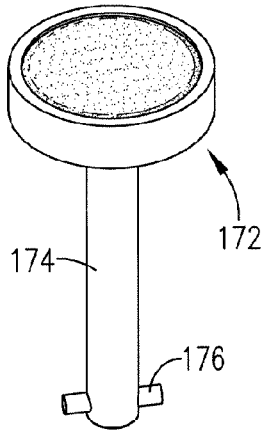

HOLDER FOR SUPPORTING WORKPIECE IN A FIXED LOCATION PIVOTAL ABOUT DUAL AXES

RELATED APPLICATIONS

This application is a continuation application of application Ser. No. 10/604,659 filed Aug. 7, 2003, bearing the same title and which is hereby incorporated by reference herein.

BACKGROUND OF THE INVENTION

1. Field of the Invention

The present invention relates generally to apparatus for supporting a workpiece in a fixed location pivotal about dual axes and especially equipment for crafting and repairing jewelry, or for artistic handwork including engraving. More specifically, the present invention concerns a workpiece supporting tool clamp, which may be held and used as an independent work support, or removably mounted on an articulating frame for releasably holding the tool clamp. The tool clamp includes a quick-release connection for easy interchanging of various jewelry-holding tools. The articulating frame enables a jewelry-laden tool clamp to be pivoted about dual axes while maintaining the jewelry held therein in a centralized work zone that remains generally fixed (e.g., fixed within the field of view of a microscope for continuous and constant viewing while crafting the jewelry).

2. Discussion of Prior Art

Jewelry crafting is an art that often demands extremely precise work within relatively tight spaces on materials that are relatively expensive to replace if mistakes occur. Jewelry craftsmen in certain instances perform their work under magnification lenses so that the finished construction of the jewelry item so that the work may be more precisely executed in an artful manner. Many problems relevant to this art are described in U.S. Pat. No. 4,744,552, assigned of record to the assignee of the present invention, issued May 17, 1988 and entitled CRAFTSMAN'S JEWELRY SUPPORT TOOL ("Glaser '552 patent").

The craftsman's jewelry supporting tool disclosed in the Glaser '552 patent was an advance in the field and solved many of the problems identified in the art at the time. However, it has been determined that jewelry craftsmen increasingly are using microscopes to magnify the jewelry item being crafted while the item is supported in a tool. These microscopes are typically fixed to a work surface to continuously project a fixed field of view. The focused field of view magnified by the microscope, however, is fairly limited and narrow. Crafting a jewelry piece typically requires frequent repositioning of either the tool and/or the jewelry piece. Such repositioning of prior art tools is problematic as each repositioning is typically associated with realigning the jewelry piece within the microscope's field of view. Such repositioning and realigning has proven time consuming and frustrating with prior art tools. Additionally, craftsmen often prefer a "feather touch" tool that retains its position but that is quickly and easily repositioned to precise and fine adjustments. Prior art tools are problematic in that when craftsmen exert a force upon the jewelry piece, the tool is prone to movement out of the desired position, whether or not the artisan chooses to rely upon microscopic viewing of the work object.

Jewelry craftsmen will typically perform several different operations on the same piece of jewelry and/or will perform operations on several different sized and configured pieces of jewelry over the course of a single day. These multiple operations often require various differing jewelry-holding tools. It is desirable to utilize a single frame and tool clamp to support the various holding tools. Some prior art tool clamps enable tool changeover, however, this changeover is problematic and subject to several limitations. For example, the changeover is time consuming and difficult to accomplish, such as in the Glaser '552 device wherein the cylindrical grip (64) must be unthreaded from the tool (58) and either held in the craftsman's hand or allowed to fall to the floor. A changeover tool must then be manually aligned with the grip (64) and rethreaded, typically requiring both of the craftsman's available hands. Additionally, the tool (58) can become wedged in the housing (16) and then must be tapped out (e.g., by hand or with a hammer, etc.). Furthermore, the prior art tools that are interchangeable in a tool clamp are relatively cumbersome (e.g., the Glaser '552 tool (58) must extend completely through the housing (16) to threadably engage the grip (64)), and thus are expensive to manufacture and undesirably consume valuable and limited inventory space on a craftsman's work bench.

SUMMARY OF THE INVENTION

The present invention provides an improved handheld tool clamp and an improved articulating frame for holding the tool clamp that do not suffer from the problems and limitations of the prior art discussed above. The inventive tool clamp enables a quick-release connection for easy interchanging of various jewelry-holding tools. The articulating frame enables a jewelry-laden tool clamp to be pivoted about dual axes while maintaining the jewelry held therein in a centralized work zone that remains generally fixed (e.g., fixed within the field of view of a microscope for continuous and constant viewing while crafting the jewelry).

One aspect of the present invention concerns an apparatus for supporting a workpiece. The apparatus broadly includes a mount adapted for fixed attachment to a support, a workpiece-supporting tool including structure for receiving and holding a workpiece, and a frame assembly coupled to the mount. The frame assembly includes first and second arms. The first arm is pivotal relative to the mount about a first axis of rotation. The second arm is pivotal relative to the first arm about a second axis of rotation. The first and second rotational axes essentially lie in a common plane and intersecting to define a work zone at the region of intersection thereof. The second arm includes an outboard portion spaced from the first arm and offset from the common plane. The outboard portion supports a fixture for receiving the workpiece-supporting tool. The fixture and workpiece-supporting tool are cooperatively oriented and configured so that a supported workpiece is located substantially at the work zone. The workpiece-supporting tool is shiftable by pivoting of the arms to selectively alter the orientation of the workpiece while maintaining the workpiece substantially within the work zone.

A second aspect of the present invention concerns a workpiece-supporting tool that broadly includes an elongated, tubular housing presenting an upper end and a lower end, a workpiece holder removably received within the housing, and a connector adjacent the housing lower end. The workpiece holder includes an upper workpiece-holding end adjacent the housing upper end and a lower end within the housing having a first latch component. The connector includes a second latch component. One of the first and second latch components comprises a protruding element such as a latch pin, and the other of the first and second latch components comprises an element or pin-receiving slot or series of slots for selective receipt of the latching element. The first and second latch components are selectively shiftable between an engaged, latching position for retaining the holder within the housing and a disengaged position permitting removal of the holder from the housing.

A third aspect of the present invention concerns a handheld workpiece support tool for an article of jewelry. The tool broadly includes a housing configured and dimensioned to be held in a hand of the craftsman, a jewelry holder removably received in the chamber and operable to support the jewelry, and a connection assembly operable to removably and adjustably couple the holder and the housing. The housing presents a holder-receiving chamber. The connection assembly includes a shaft and a nut. At least a portion of the shaft is removably and threadably received within the nut so that threading of the shaft into the nut adjusts the holder relative to the housing. At least a portion of the nut is rotatably supported on the housing when the shaft is removed from the nut.

A fourth aspect of the present invention concerns a set of jewelry-supporting craftsman's tools, each tool being interchangeable into and out of a workpiece support tool wherein the workpiece support tool includes a tool-receiving chamber. The set of tools broadly may include a tool selected from a group including for example, a jaw-type tool, a multi-purpose vise, an inside ring holder, and a pitch cup. The tool includes a shaft configured to be received within the tool-receiving chamber for removable coupling to the tool clamp and generally defining an elongated axis. The tool includes a crossbar coupled to the shaft and dimensioned and configured to be received within the tool-receiving chamber. The crossbar extends generally transversely from the elongated axis.

A fifth aspect of the present invention concerns an apparatus for supporting a workpiece. The apparatus broadly includes a frame assembly adapted to be coupled relative to a support and including first and second arms, and a handrest removably coupled relative to the frame assembly and presenting an upwardly oriented wrist-supporting surface. The first arm is pivotal about a first axis of rotation and the second arm is pivotal relative to the first arm about a second axis of rotation. The first and second rotational axes are essentially lying in a common plane and intersecting to define a work zone at the region of intersection thereof. The handrest is movable between first and second positions wherein the handrest is adjacent one side of the work zone when in the first position and adjacent the opposite side of the work zone when in the second position. The wrist-supporting surface remains upwardly oriented when the handrest is the first position and when the handrest is in the second position.

A craftsman routinely performs work on a piece of jewelry or other workpiece in a sequence of steps. These sequential operations are desirably performed without releasing the item of jewelry or workpiece from the workpiece supporting tool assembly until all of the required steps have been completed. The sequential steps include operations performed while the workpiece supporting tool assembly is supported and, in certain instances fixedly held in place, in the pivoting support frame attached to the craftsman bench. Exemplary in this respect is stone setting and soldering. Next, the workpiece supporting tool assembly with the item of jewelry or other workpiece still clamped in the workpiece supporting tool assembly may be removed from the support frame and handheld to carry out procedures such as polishing and cleaning, which commonly are accomplished at a separate work station remote from the craftsman work bench such as a large polishing, buffing station, or using pressure steam cleaning apparatus. Consequently, this latter step requires that the workpiece supporting tool assembly be easily removed from the pivoting support frame and then readily returned to its cradled position. Accordingly, a preferred embodiment of the workpiece holding system of the present invention includes a frame assembly, a workpiece-supporting tool assembly removably coupled to the frame assembly, and a removable ambidextrous handrest assembly that cooperatively enable the above-described sequential operations to be efficiently and effectively performed without removing the jewelry piece from the tool assembly.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein:

FIG. 9 is a perspective view of the workpiece-supporting tool assembly of the system illustrated in FIGS. 1-8 with the jaw tool partially drawn into the tool assembly clamp;

FIG. 10 is sectional view of the tool assembly illustrated in FIG. 9 with the jaw tool and the receiver only partially shown in section;

FIG. 11 is a sectional view of the tool assembly taken substantially along line 11-11 of FIG. 10;

FIG. 12 is a sectional view of the tool assembly taken substantially along line 12-12 of FIG. 10;

FIG. 13 is a perspective exploded assembly view of the tool assembly illustrated in FIGS. 9-12 illustrating the assembly thereof with the jaw tool;

FIG. 14 is a perspective view of the multi-purpose vise tool of the system illustrated in FIGS. 1-13 configured for interconnection with the workpiece support tool assembly clamp;

FIG. 15 is a perspective view of the horizontal axis inside ring holder tool of the system illustrated in FIGS. 1-14 configured for interconnection with the tool assembly clamp;

FIG. 16 is a perspective view of the vertical axis inside ring holder of the system illustrated in FIGS. 1-15 configured for interconnection with the tool assembly clamp;

FIG. 17 is a perspective view of the pitch cup tool of the system illustrated in FIGS. 1-16 configured for interconnection with the tool assembly clamp;

FIG. 18 is a front elevational view of the pitch cup illustrated in FIG. 17 interconnected with the tool assembly clamp with the tool assembly clamp shown in section and fragmentary;

DETAILED DESCRIPTION OF THE PREFERRED EMBODIMENTS

Figure 1:
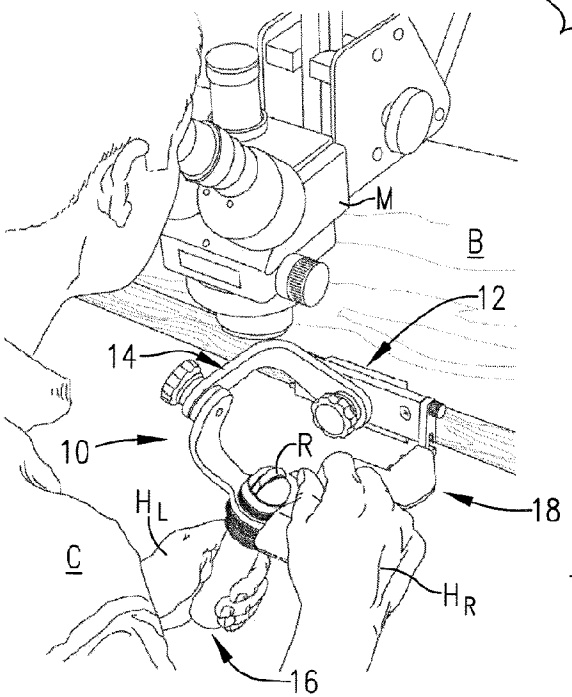
FIG. 1 is a perspective view of a workpiece holding system constructed in accordance with a preferred embodiment of the present invention and shown supported on a work bench being manipulated by a craftsman while viewing the workpiece through a microscope.

Referring initially to FIG. 1, a workpiece holding system 10 constructed in accordance with the principles of a preferred embodiment of the present invention is shown. The system 10 is particularly well suited for holding a piece of jewelry, such as a ring R, for crafting thereof by a craftsman C. The craftsman C typically works at work bench B and uses both his left hand HL and his right hand HR to manipulate components of the system 10 while crafting the workpiece R. Additionally, the craftsman C will often use additional equipment supported on and/or around the work bench B to facilitate crafting the workpiece R. For example, magnifying devices, such as a microscope M, are frequently used to magnify the workpiece R during crafting thereof. The principles of the present invention, however, are not limited to jewelry crafting and could be applied to any application where it is desirable to securely hold a workpiece for manipulation thereof. The illustrated system 10 broadly includes a mounting assembly 12, a frame assembly 14 coupled to the mounting assembly 12, a workpiece-supporting tool assembly 16 removably coupled to the frame assembly 14, and a handrest assembly 18 removably coupled to the mounting assembly 12.

In more detail, and as shown in FIGS. 1-6, the mounting assembly 12 removably couples the frame assembly 14 to a support surface, such as the work bench B. The illustrated mounting assembly 12 includes a mount 20 and a plate 22 removably coupled to the mount 20. The mount 20 is a plate-like structure having a front surface 24 (see FIG. 4) that is trapezoidal in shape and having a top surface 26 (see FIG. 2) that is also trapezoidal in shape. The mount 20 is fixed to the support surface B in any suitable manner (e.g., with screw-type fasteners, etc.) so that the top surface 26 is facing up and the front surface 24 is facing away from the bench B. As described in more detail below, the plate 22 is configured for attachment to the frame assembly 14. The plate 22 is over sized relative to the mount 20 and includes dovetail blocks 28 and 30 projecting from a rear surface of the plate 22 and configured for complemental interengagement with the mount 20 (see FIG. 2). In this manner, the blocks 28,30 are dimensioned to slide over the top surface 26 of the mount 20 and engage the sloped edges of the trapezoidal surface 24 until the blocks 28,30 dovetail with the mount 20 to thereby easily and securely engage the plate 22 to the mount 20 in a flush configuration. The mounting assembly 12 preferably includes means (not shown) for selectively locking the frame assembly 14 to the support surface B. Such a selectable locking mount construction is disclosed in applicants' contemporaneously filed application for U.S. patent Ser. No. 10/604,660, entitled LOCKABLE MOUNT PLATE, which is hereby incorporated by reference herein as is necessary for a full and complete understanding of the present invention. The mounting assembly 12 could be variously configured, for example, the mounting assembly 12 need not removably couple the frame assembly 14 to the support surface B (e.g., the frame assembly 14 could be fixedly coupled to the support surface B, etc.).

The frame assembly 14 is configured to support the workpiece-supporting tool assembly 16 for articulatory movement relative to the mounting assembly 12 and thus the support surface B. In more detail, and as shown in FIGS. 1-8, the frame assembly 14 includes an L-shaped mounting arm 32 pivotally coupled to the plate 22 and an L-shaped tool assembly arm 34 pivotally coupled to the mounting arm 32. In particular, the mounting arm 32 includes a proximate end 32*a* adjacent the plate 22 and distal end 32*b* spaced from the plate 22. The proximate end 32*a* is pivotally connected to the front surface of the plate 22 for pivoting about an X-axis of rotation (designated as X in FIG. 2). The tool assembly arm 34 includes a proximate end 34*a* adjacent the distal end 32*b* of the mounting arm 32 and a distal end 34*b* spaced from the distal end 32*b* of the arm 32. The distal end 34*b* of the tool assembly arm 34 includes a tool assembly-supporting fixture 36 as will be described in detail below. The proximate end 34*a* of the arm 34 is pivotally connected to the inside surface of the distal end 32*b* of the mounting arm 32 for pivoting about a Y-axis of rotation (designated as Y in FIG. 2).

Figure 7:
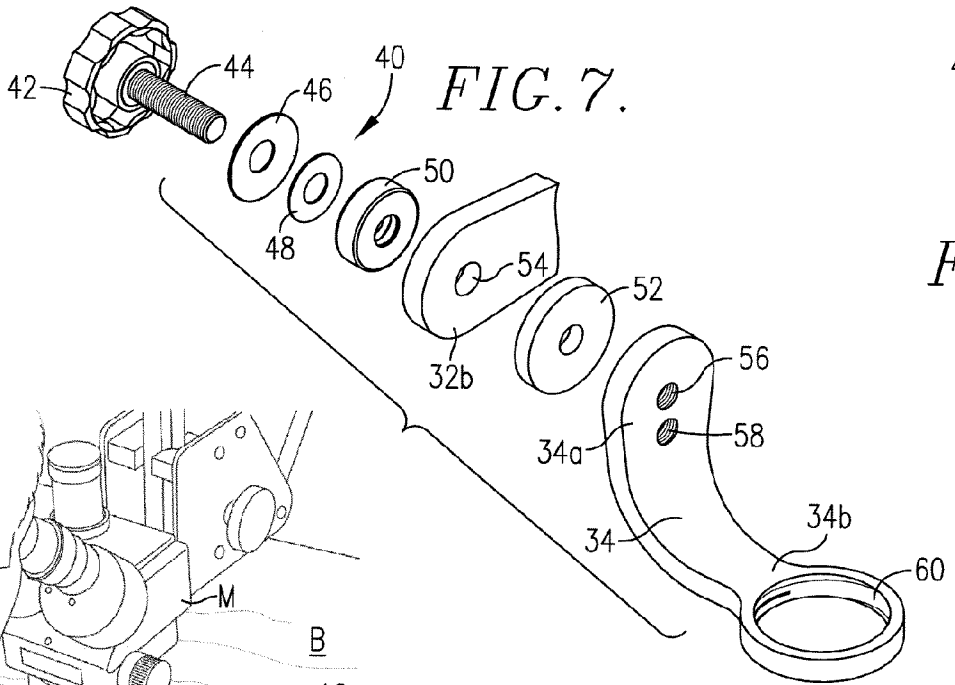
FIG. 7 is a perspective exploded assembly view of the coupling mechanism that pivotally couples the tool assembly arm to the mounting arm of the frame assembly of the system illustrated in FIGS. 1-6 with the mounting arm shown in fragmentary.

The pivotal connection between the arm 32 and the plate 22 and between the arms 32 and 34 are provided by corresponding coupling assemblies 38 and 40, respectively. The coupling assemblies 38,40 are virtually identically configured and accordingly only the coupling assembly 40 will be described in detail with the understanding that the coupling assembly 38 is similarly constructed. As shown in FIG. 7, the illustrated coupling assembly 40 is preferably a finger-actuated coupling mechanism including a knob 42 fixed to a threaded shaft 44, an annular disc spring 46, a washer 48, a bearing 50, and a spacer 52. The shaft 44 is received through an aperture 54 in the end 32*b* of arm 32 and is threadably received in one of a pair of threaded apertures 56 and 58 (as will be subsequently described in more detail) in the end 34*a* of the arm 34. Similar coupling mechanisms are disclosed and described in U.S. Pat. No. 4,744,552, assigned of record to the assignee of the present invention, issued May 17, 1988 and entitled CRAFTSMAN'S JEWELRY SUPPORT TOOL ("Glaser '552 patent"), which is hereby incorporated herein by reference as is necessary for a complete understanding of the present invention. Suffice it to say that the coupling mechanisms 38,40 provide a similar type of selective minute adjustment of the degree of resistance to movement of the arms 32,34 as described in the Glaser '552 patent. Once the desired adjustment is set by the craftsman C (e.g., by rotating the knob 42), the arms 32 and 34 can be independently rotated about their respective X and Y axes.

Figure 2:
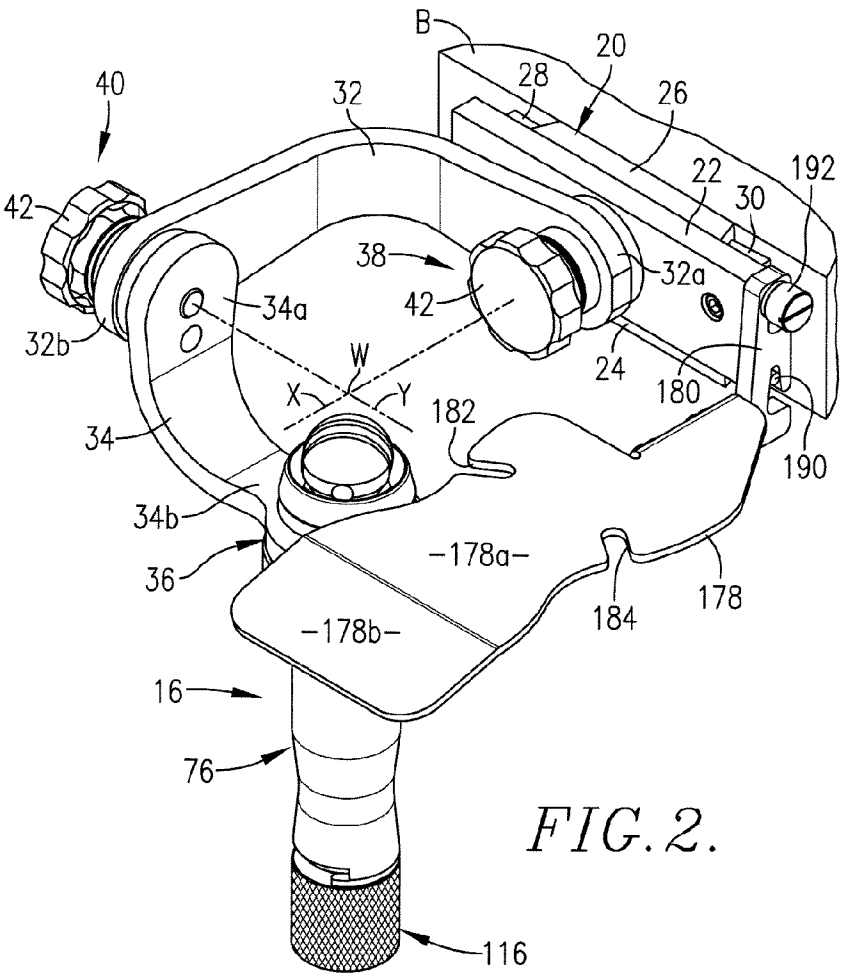
FIG. 2 is a perspective view of the system illustrated in FIG. 1 shown in combination with the work bench in fragmentary and illustrating the handrest assembly in a right-hand orientation.

In the illustrated frame assembly 14, and perhaps as best shown in FIG. 2, the X and Y axes of rotation are coplanar and perpendicular relative to one another. The X and Y axes retain this coplanar, transverse relationship throughout the full range of motion of the frame assembly 14 (i.e., as either or both of the arms 32,34 are pivoted). In this manner, the axes X and Y intersect to define a work zone (designated as W in FIG. 2) at the region of intersection thereof. In the illustrated frame assembly 14, the relationship of the X and Y axes is provided by the L-shaped configuration of the arm 32 and the positioning of the respective pivot points of the arms 32,34 along the arm 32. The L-shaped configuration of the arms 32,34 and the spacing of the pivot points along the arm 32 in the illustrated frame assembly 14 also provide sufficient work space surrounding the work zone W for the craftsman C to maneuver while crafting the workpiece R. The frame assembly 14 could be variously configured, however, for purposes that will subsequently be described, it is important that the X and Y axes present and maintain a coplanar relationship and intersect to define the work zone W.

Figure 8:
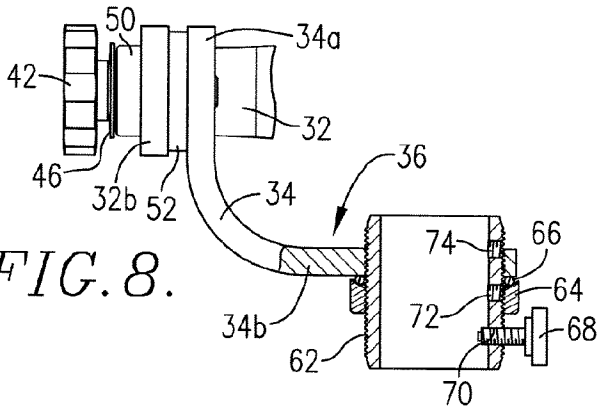
FIG. 8 is a front elevational view of the frame assembly of the system illustrated in FIGS. 1-7 with the tool assembly arm fixture, including the collar, shown in section and the mounting arm shown in fragmentary.

As indicated above, the distal end 34*b* of the tool assembly arm 34 includes the tool assembly-supporting fixture 36. In particular, in the illustrated frame assembly 14, the fixture 36 includes an internally threaded neck 60 formed in the end 34*b* and configured to adjustably receive a collar 62 (see FIGS. 4-8). The collar 62 is dimensioned and configured to adjustably and removably receive the workpiece-supporting tool assembly 16. In more detail, the collar 62 includes external threading so that the collar 62 can be threaded into the neck 60 and adjusted up or down relative thereto by rotating the collar 62. A knurled lock ring 64 is threadably received on the collar 62 for locking the position of the collar 62 relative to the neck 60 once the desired adjusted position is set. In the illustrated frame assembly 14, the neck 60 and collar 62 are preferably formed of metal (e.g., stainless steel, aluminum, oxided steel, etc.), accordingly an O-ring 66 is positioned between the neck 60 and the collar 62 to prevent undesired metal-to-metal contact therebetween. For purposes that will subsequently be described, it is important that when the tool assembly 16 is received in the fixture 36, the tool assembly 16 can be finely adjusted. Accordingly, in addition to the threaded adjustment just described, the tool assembly 16 can be adjusted relative to the collar 62. This is accomplished with a set screw 68 that projects through the collar 62 to lockingly engage the tool assembly 16 received therein. As shown in FIG. 8, the screw 68 can be positioned in any one of three apertures 70, 72, or 74 formed in the collar 62 to allow the screw to be positioned clear of the locking ring 64 regardless of its position. Additionally, the positioning of the tool assembly 16 relative to the work zone W can also be adjusted by coupling the arm 34 to the arm 32 in the aperture 58 rather than the aperture 56 or vice versa. The adjustability of the tool assembly 16 relative to the frame assembly 14 can be accomplished in a variety of alternative manners and can include alternative configurations for the fixture 36 as well.

Using one or more of the adjustment mechanisms described above, when the workpiece R is secured in the tool assembly 16 and the assembly 16 is received in the frame assembly 14, the location of the workpiece R can be adjusted so that the workpiece is positioned in the work zone W. In the inventive frame assembly 14, when the workpiece is positioned in the work zone W, either or both arms 32,34 can be rotated throughout their full range of motion and the workpiece R will remain in the work zone W. Maintaining the workpiece R in the work zone W while the craftsman C maneuvers and crafts the workpiece R is advantageously desirable for the craftsman C. For example, if the craftsman C is using the microscope M to magnify the workpiece R during crafting, maintaining the workpiece R within the work zone W and thus within the microscope's limited field of view prevents the craftsman C from having to frequently and undesirably readjust the workpiece R or refocus the microscope M. It will be appreciated that the X and Y axes intersect at a finite point, however, typical workpieces are larger than this finite point. Accordingly, the term substantially as used herein to describe the workpiece's location relative to the work zone W incorporates positioning the workpiece so that at least a portion thereof is at or very near the intersection of the X and Y axes. In the illustrated frame assembly 14, the fixture 36 is spaced from the work zone W to ensure that when the tool assembly 16 is received therein, the workpiece R held in the tool assembly 16 can be adjusted adequately to place the workpiece R substantially in the work zone W.

Turning now to FIGS. 9-13, the workpiece-supporting tool assembly 16 is configured to support the workpiece R and can be manipulated by the craftsman C either while supported in the frame assembly 14 or while held in one of the craftsman's hands HL, HR. The illustrated tool assembly 16 broadly includes a tool assembly clamp 76, at least one tool 78 configured to hold the workpiece R, and a connection assembly 80 configured to removably couple the tool 78 and the tool assembly clamp 76. In more detail, the tool assembly clamp 76 includes an elongated tubular housing 82 presenting a cylindrical wall 84 that defines an internal tool-receiving chamber 86 and an exterior surface 88. The housing 82 is configured and dimensioned to be handheld (i.e., held within either hand HL,HR of the craftsman C) and received within the fixture 36 of the frame assembly 14. In this latter regard, the housing 82 includes a flange 90 positioned at the upper end of the housing 82 and presenting a circumferential dimension greater than the outer circumferential dimension of the cylindrical wall 84. In this manner, the housing 82 can be inserted into the collar 62 lower end first and slidably received therein until the flange 90 engages the top of the collar 62 and prevents the housing 82 from sliding out of the collar 62. The exterior surface 88 includes a recessed portion 88*a* adjacent the flange 90 and configured to complement the interior dimensions of the collar 62 for interengagement with the set screw 68 for adjustably coupling the housing 82 to the frame assembly 14. The exterior surface 88 further includes an arcuate recessed portion 88*b* adjacent the lower end of the housing 88 to facilitate a secure an ergonomic gripping of the housing 82 by the craftsman C.

The internal chamber 86 of the housing 82 includes an upper section 86*a* having a generally uniform diameter and a lower section 86*b* having a diameter that is smaller relative to that of the upper section so that an annular ledge 92 is formed therebetween (see FIG. 10). As shown in FIG. 11, a keyway 94 is formed in the lower section 86*b* as will subsequently be described. For purposes that will be described below, formed at the top of the upper section 86*a* (e.g., inside the flange 90) is an internal camming surface 96. The bottom of the housing 82 is open and communicates with the lower section 86*b* of the chamber 86. As shown in FIG. 12, formed in the housing 82 adjacent the open bottom thereof is an annular lip 98 open on one side of the wall 84 and an annular slot 100 positioned above the lip 98 (described in detail below).

The tool 78 illustrated in FIGS. 9, 10, and 13 is a clamp-type workpiece holder and is configured to be received in the tool assembly clamp 76 to adjustably hold various workpieces such as the workpiece R. The illustrated tool 78 includes a pair of integrally formed opposed jaws 102 and 104 emanating from a shaft 106. The jaws 102,104 are yieldably biased away from each other to the position illustrated in FIG. 10. In the illustrated tool 78, the yieldable biasing is provided by the integral formation of the jaws 102,104 from a unitary piece of sturdy, yet flexible metal, such as steel. The head of each jaw 102,104 includes an inside facing 102*a* and 104*a*, respectively, preferably formed of a material that resists marring of the workpiece carried by the jaws 102,104, such as for example polypropenate. The illustrated tool 78 further includes a compressible seal 108 (e.g., formed from foam, etc.) that encircles the arms of the jaws 102,104 to at least partially sealingly engage the inside surface of the wall 84 at the upper section 86*a* thereof. For purposes that will become apparent, the seal 108 prevents debris (e.g., metal shavings, etc.) from falling into the connection assembly 80 and/or the lower section 86*b* of the internal chamber 86. It will be appreciated that the tool 78 is similar in some respects to the jewelry supporting jaws described in the Glaser '552 patent previously incorporated herein by reference. It is within the ambit of the present invention to utilize various alternative tools for holding the jewelry in the tool assembly clamp 76 and some similar type tools are known in the art.

As previously indicated, the tool 78 is configured to be received in the tool assembly clamp 76 to adjustably hold various workpieces and the connection assembly 80 is configured to removably and adjustably couple the tool 78 and the clamp 76. In more detail, the connection assembly 80 broadly includes a receiver 110 presenting a pin-receiving slot 112, a latch pin 114 configured and dimensioned for slidable receipt in the slot 112, and a captive nut 116. The illustrated receiver 110 includes a partially threaded receiver shaft 118 at its lower end and a boss 120 at its upper end. The shaft 118 is dimensioned and configured to slide within the lower section 86*b* of the internal housing chamber 86. The boss 120 is dimensioned and configured to slide within the upper section 86*a* of the chamber 86 and engage the annular ledge 92 to prevent the receiver 110 from sliding out of the open bottom of the housing 82. The shaft 118 includes a key 122 projecting therefrom and configured to be received within the keyway 94. For purposes that will subsequently be described, when the receiver 110 is slidably received within the chamber 86 and the key 122 aligns with the keyway 94, the threaded portion of the shaft 118 is enabled to slide past the annular slot 100 and through the annular lip 98 out of the open bottom of the housing 82 until the boss 120 engages the ledge 92. However, when the key 122 does not align with the keyway 94, the key 122 engages the ledge 92 to prevent the threaded portion of the shaft 118 from passing into the slot 100. From this position, the receiver 110 can be rotated until the key 122 engages the keyway 94 when desired.

The captive nut 116 is complementally configured to be slidably received on the lip 98 for rotatable support on the housing 82 and threadably engage the receiver shaft 118 for threadable adjustment therebetween. In particular, the nut 116 includes a generally cylindrical wall 124 defining a threaded internal chamber 126. The wall 124 preferably presents a gripping exterior surface, such as a knurled configuration. Projecting from the top of the wall 124 is a flange 128 spaced from the wall 124 by a circumferentially recessed neck 130. The flange 128 and neck 130 are dimensioned and configured so that the flange 128 is slidably received in the annular slot 100 and supported on the annular lip 98 to rotatably support the nut 116 on the housing 82. In order to captivate the nut 116 in the housing 82, the receiver 110 should be positioned so that the key 122 engages the ledge 92 to prevent the shaft 118 from interfering with the slot 100. Once the captive nut 116 is slid into the slot 100, the key 122 can be aligned with the keyway 94 to allow the threaded portion of the shaft 118 to threadably engage the nut 116. When the captive nut 116 is rotated in a tightening direction (e.g., in a clockwise direction when viewed as shown in FIG. 12), the engagement of the key 122 and the keyway 94 prevent the receiver shaft 118 from rotating and thereby enable the shaft 118 to thread into the nut 116 thereby sliding the receiver 110, and thus the boss 120, further down the chamber 86.

The boss 120 is configured and dimensioned to removably receive the bottom end of the shaft 106 of the tool 78 to thereby couple the tool 78 to the tool assembly clamp 76 and enable adjustment relative thereto as the boss 120 slides up and down the chamber 86. Particularly, the boss 120 includes a graduated central recess 132 having an upper shaft-receiving section 132*a* and a lower spring-receiving section 132*b* (see FIG. 10). Formed in the boss 120 on opposite sides of the recess section 132*a* are complementing helical shaped slot sections 134 and 136 (see FIG. 13). The slot sections 134 and 136 cooperate to define the pin-receiving slot 112 for receiving the latch pin 114. In particular, the helical shaped slot sections 134, 136 guide the pin 114 along the slot 112 as the pin 114 is rotated into and out of an engaged position wherein the pin 114 is captured in the boss 120 at the end of the helical sections 134, 136 as shown in FIG. 10. At the middle of each helical slot section 134, 136 is a lower-most point (with only lower-most point 134*a* being shown in FIG. 13).

The latch pin 114 is fixedly coupled to the shaft 106 of the tool 78. Particularly, the pin 114 is a crossbar that extends transversely through the lower end of the shaft 106 and protrudes out of either side thereof (see FIGS. 10 and 13). The pin 114 is sized and configured to freely slide into and out of the upper section 86*a* of the chamber 86 to thereby be received in the slot 112. A spring 138 rides in the spring-receiving recess 132*b* of the receiver 110 to engage the bottom of the shaft 106 when the tool 78 is received in the chamber 86. In this manner, the spring 138 yieldably biases the shaft 106, and thus the tool 78, into and out of the engaged position as the pin 114 is rotated to slide past the lower-most point 134*a* in the slot 112. Particularly, as the tool 78, and thus the latch pin 114, is rotated in a clockwise direction (when viewed from the top) the spring 138 biases the pin 114 into the engaged position as the pin 114 moves past the lower-most point 134*a*. From this position, the tool 78 can be slightly depressed to overcome the spring 138 and simultaneously rotated in a counter clockwise direction (when viewed from the top) to slide the latch pin 114 out of the engaged position. As the pin 114 passes the lower-most point 134*a* on the helical slot section 134, the tool 78 can be released and the spring 138 then biases the pin 114, and thus the tool 78, out of the engaged position wherein the tool 78 can be removed from the chamber 86, and thus the tool assembly clamp 76.

When the tool 78 is received in the tool assembly clamp 76 and is rotated into the engaged position, the captive nut 116 can be rotated in a tightening direction (i.e., clockwise when viewed from the top as shown in FIG. 12) to threadably draw the receiver 110, and thus the tool 78, further into the chamber 86. As the tool 78 is adjustably drawn further into the chamber 86, the jaws 102, 104 of the tool 78 engage the cam surface 96 and are thereby drawn closer together (see FIG. 10). In this manner, the jaws 102,104 can be pressed together to securely hold various sized workpieces, such as the ring R. It will be appreciated that in order to remove the tool 78, the nut 116 may have to be rotated in a loosening direction (i.e., counter clockwise when viewed from the top as in FIG. 12) to allow the jaws 102,104 to sufficiently clear the cam surface 96 so that the tool 78 can be adequately depressed and rotated to disengage the latch pin 114 from the slot 112.

The connection assembly 80 provides a quick and easy coupling of the tool 78 with the tool assembly clamp 76. In order to couple the tool 78 with the tool assembly clamp 76, i.e., position the latch pin 114 into the engaged position, the tool 78 need only be rotated less than one revolution. Similarly, to remove the tool 78 from the tool assembly clamp 76, i.e. position the latch pin 114 out of the engaged position, the tool 78 need only be rotated in the opposite direction less than one revolution. In this manner, the tool 78 can be quickly removed from the tool assembly clamp 76 and another similarly configured tool can be easily interchanged. However, the connection assembly 80 provides a secure coupling of the tool 78 and the tool assembly clamp 76 that can be quickly and finely adjusted to draw the tool 78 into the desired position. The captive nut 116 further enables a tool interchange wherein the nut 116 remains trapped in the housing 82 and thus does not fall to the ground or need to be held during a tool changeover. It is within the ambit of the present invention to utilize various alternative configurations for the connection assembly. For example, the captive nut could be trapped in the housing a variety of ways, or the crossbar and slot configuration could be reversed, or could be replaced with a different latching mechanism altogether. However, it is important that the connection assembly enable a quick and easy tool changeover. Although the workpiece-supporting tool assembly 16 is preferably used in connection with the illustrated system 10, it is within the ambit of the present invention to utilize the tool assembly 16 to provide the quick tool change qualities to virtually any frame assembly, such as the frame assembly disclosed in the Glaser '552 patent.

As previously indicated, the illustrated tool 78 is just one of many workpiece holding tools that can be removably coupled in the tool assembly clamp 76. As shown in FIGS. 14-18, virtually any type of workpiece holding tool can be fitted with a crossbar similar to the previously described latch pin 114 and configured for interconnection with the tool assembly clamp 76. In this manner, the craftsman C can initially invest in a single mounting assembly, frame assembly and tool clamp assembly, and supplement that system with various additional workpiece holding tools to provide a flexible and diverse system for holding virtually every type of jewelry or other workpieces. In FIG. 14, a multi-purpose vise 140 is shown including a pair of pin plates 142 and 144 integrally formed with a shaft 146. The vise 140 further includes a crossbar 148 fixed to the shaft 146. With the exception of the plates 142,144, the vise 140 is similarly configured to the previously described tool 78 and operates in a similar manner. However, unlike the jaws 102,104 of the tool 78, the plate 142,144 are configured to receive a plurality of pins 150 in various selected positions. In this manner, odd shaped workpieces (e.g., a brooch, a locket, etc.) can be supported between the pins 150 and securely clamped in place when the vise 140, coupled in the tool assembly clamp 76 in the engaged position, is drawn further into the chamber by tightening the captive nut 116 relative to the receiver shaft 106.

FIGS. 15 and 16 illustrate inside ring holders 152 and 154, respectively. Each of the inside ring holders 152,154 include a shaft 156 and 158, respectively, and a crossbar 160 and 162 configured for interconnection with the receiver 110 in a manner similar to that described above. The ring holder 152 is configured to hold a ring, such as the ring R, about a horizontal axis (relative to the tool assembly clamp 76) while the ring holder 154 is configured to hold a ring about a vertical axis. In one manner known in the art, each ring holder 152,154 includes a corresponding collet 164 and 166, respectively, and a corresponding expansion screw 168 and 170 for expanding the collet 164,166 as the screw 168,170 is tightened. Each ring holder 152,154 could be fitted with variously sized collets (not shown) to accommodate different sized rings.

A pitch cup 172 is illustrated in FIGS. 17 and 18 and includes a shaft 174 and a crossbar 176 dimensioned and configured for removable interconnection with the receiver 110. In one manner known in the art, the pitch cup 172 is filled with a heat-softened material that hardens as it cools. In this manner, workpieces (e.g., pendants, etc.) can be securely held in the hardened material for support while crafting thereon (e.g., monogramming, etc.). It is within the ambit of the present invention to utilize various other workpiece holding tools configured for removable interconnection in the receiver 110 to expand the capabilities of the system 10.

Returning now to FIGS. 1-6, as previously indicated, the handrest assembly 18 is removably coupled to the mounting assembly 12. The handrest assembly 18 is configured to support the left hand HL and/or the right hand HR of the craftsman C while he is manipulating and/or crafting the workpiece R supported in the system 10. In more detail, the handrest assembly 18 includes a handrest 178 and a bracket 180 configured to removably and adjustably couple the handrest 178 to the plate 22 of the mounting assembly 12. The handrest 178 presents an upwardly oriented wrist-supporting surface 178*a* having a declined distal section 178*b*. The handrest 178 includes opposing recesses 182 and 184 configured to receive attachments such as a mechanical third hand (not shown). The handrest 178 further includes a slotted bracket-receiving member 186 extending downwardly and generally transversely from the proximate end of the surface 178*a*. The member 186 is positioned generally towards the center of the handrest 178 to facilitate the mirror ambidextrous capabilities of the handrest assembly 18 as will subsequently be described.

Figure 3:
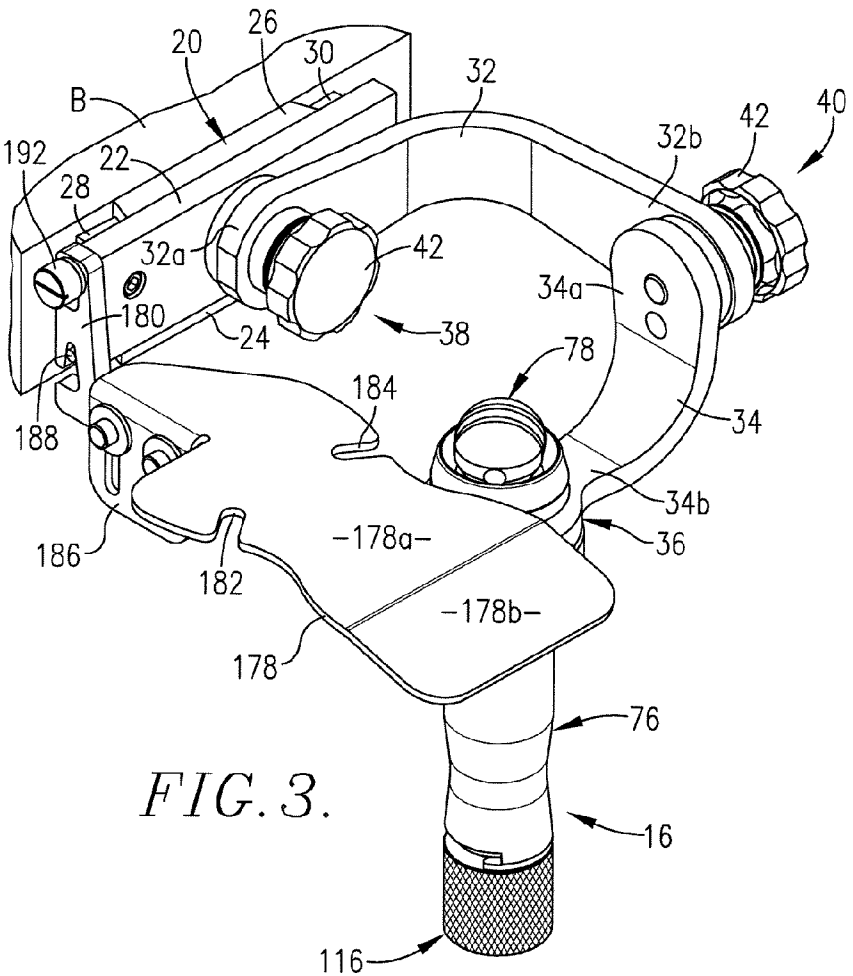
FIG. 3 is a perspective view of the system similar to FIG. 2 illustrating the handrest assembly in a left-hand orientation.
Figures 4, 5, 6:
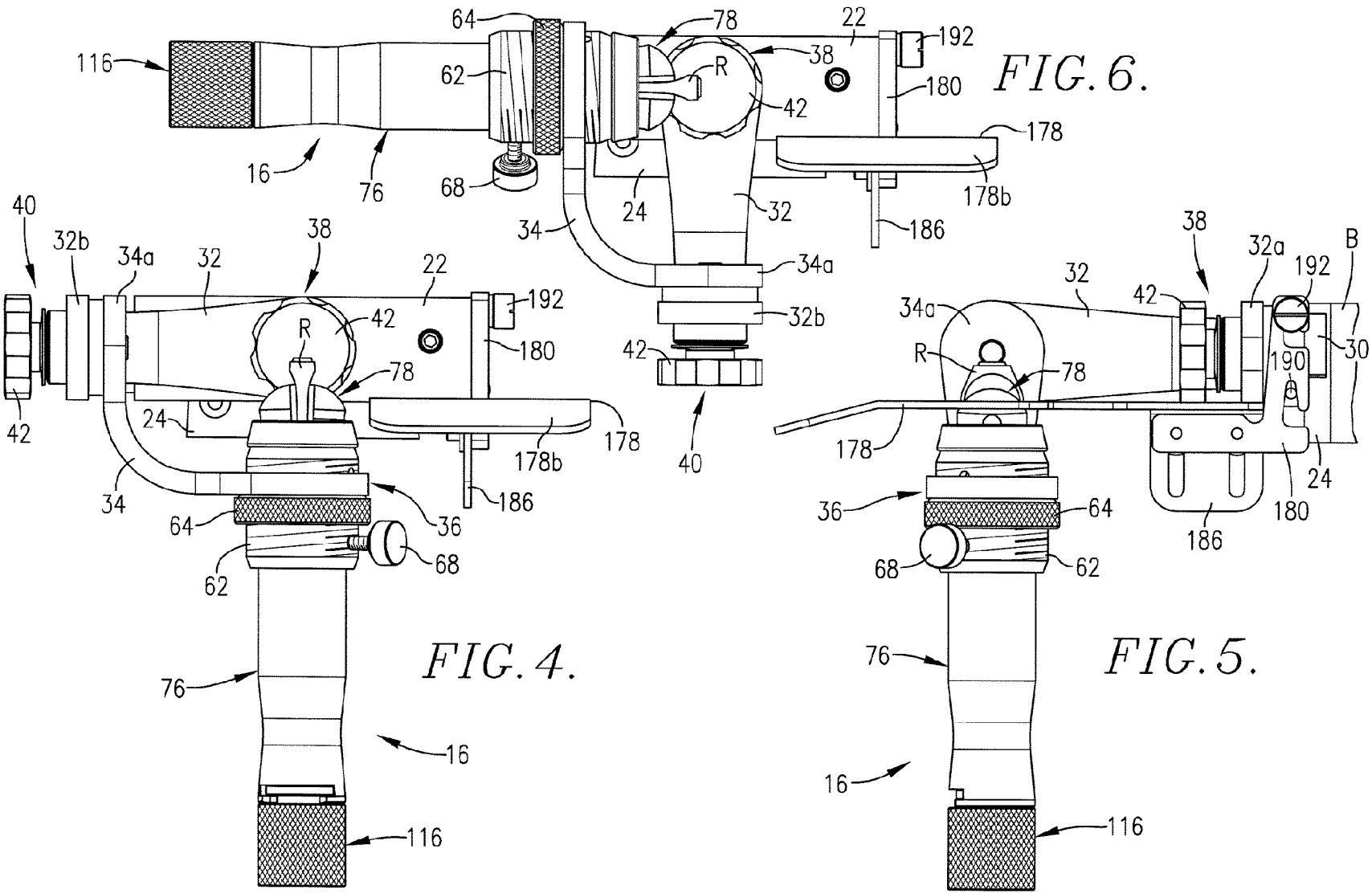
FIG. 4 is a front elevational view of the system illustrated in FIGS. 1-3 shown with a workpiece supported in the tool assembly and positioned at or very near the work zone.
FIG. 5 is a side elevational view of the system illustrated in FIG. 4 shown with the workpiece supported in the tool assembly and in combination with the work bench in fragmentary.
FIG. 6 is a front elevational view of the system illustrated in FIGS. 1-4 shown with the workpiece at the work zone and illustrating the mounting and tool assembly arms of the frame assembly rotated to support the tool assembly in a horizontal orientation.

The handrest 178 is removably and adjustably coupled to the plate 22 by the bracket 180. In particular, at its distal end, the bracket 180 is screwed to the slotted member 186, with the slots therein providing vertical adjustment of the handrest 178. The proximate end of the bracket 180 is configured to be hangingly received on either end of the plate 22. The plate 22 includes a pair of plate pins 188 and 190, each extending from the lower portion of the respective ends of the plate 22. Formed in each end of the plate 22 upwardly spaced from the corresponding pin 188,190 is a threaded screw-receiving aperture (not shown). A thumb screw 192 is selectively and removably threadable into the screw-receiving apertures in the plate 22. When the thumb screw 192 is threaded into one of the apertures, it cooperates with the corresponding pin 188,190 to enable the proximate end of the bracket 180 to hang therefrom. The screw 192 can be tightened against the bracket 180 to secure the bracket 180 to the plate 22. In order to reposition the handrest assembly 18 to the opposing side of the plate 22, the screw 192 is simply removed and replaced in the opposing screw-receiving aperture. If desired, an additional screw (not shown) could be utilized so that the screw 192 need only be loosened but not removed from the plate 22 in order to reposition the handrest assembly 18. The repositionable nature of the handrest assembly 18 enables the handrest assembly 18 to be movable between a right-hand position as shown in FIG. 2 and a left-hand position as shown in FIG. 3. In this regard, when the frame assembly 14 is properly pivoted between the positions shown in FIGS. 2 and 3, the handrest assembly 18 cooperates therewith to enable mirrored ambidextrous use of the system 10. Although the handrest assembly 18 is preferably used with the illustrated system 10, the unique mirrored ambidextrous use of the handrest assembly 18 is not limited to the illustrated frame assembly 14 and could be used to provide the ambidextrous qualities to virtually any frame assembly, such as the frame assembly disclosed in the Glaser '552 patent.

In operation, the mount 20 is secured to the work bench B. The frame assembly 14 is then coupled to the plate 22 by sliding the shaft of the coupling assembly 38 through the arm 32 and threading it into the plate 22. The plate 22 is then slid over the mount 20 until it dovetails therewith. The workpiece-supporting assembly 16 is next prepared for placement into the frame assembly 14. The receiver 110 is first slid into the chamber 86 of the housing 82 until the key 122 rests on the ledge 92 and then the captive nut 116 is slid into the annular slot 100 in the housing 82. The receiver 110 is then rotated (e.g., using any tool having a crossbar) until the key 122 aligns in the keyway 94 to enable the nut 116 to be partially threaded onto the receiver shaft 118. An appropriate tool is then selected for clamping into the tool assembly clamp 76 to support the workpiece being crafted. For example, if the ring R is being crafted, an appropriate tool might be the tool 78. The tool 78 is then inserted into the chamber 86 until the latch pin 114 contacts the slot 112 of the receiver 110. The tool 78 is then depressed and rotated until the latch pin 114 is in the engaged position. The ring R is next placed between the jaws 102,104 and the captive nut 116 is tightened until the jaws 102,104 are drawn into secure engagement with the ring R.

The workpiece-supporting assembly 16, now ready for placement into the frame assembly 14, is next slid into the collar 62 until the flange 90 engages the collar 62 and the set screw 68 may be tightened if it is desired to secure the tool assembly 16 to frame assembly 14. The collar 62 is then adjusted relative to the arm 34 until the workpiece R is positioned very near or at the work zone W. Specifically, the collar 62 is threaded relative to the neck 60 of the fixture 36 until the desired position is achieved and the lock ring 64 is secured against the fixture 36. The handrest assembly 18 is then secured in the desired position.

The system 10 is now ready for operation. If desired, the craftsman C can focus the magnification of the microscope M on the work zone W. The workpiece R can then be crafted. During crafting, the craftsman C can grip the housing 82 of the tool assembly clamp 76 and maneuver the clamp 76 to thereby manipulate the articulating frame assembly 14 into any desired position. The workpiece R advantageously and desirably remains in the work zone W throughout the full range of motion of the frame assembly 14. The workpiece-supporting assembly 16 can also be removed from the frame assembly 14 if desired. If the craftsman C desires to change tooling or begin crafting another workpiece, any one of the tools 140, 152, 154, or 172 can be quickly and easily changed over into the clamp 76.

Figure 19:
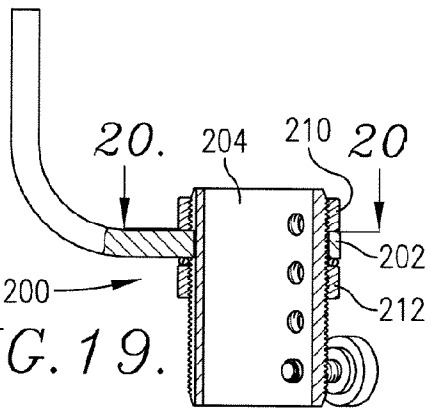
FIG. 19 is a front elevational fragmentary view of a frame assembly constructed in accordance with a preferred alternative embodiment of the present invention with the tool assembly arm fixture, including the collar, shown in section.
Figure 20:
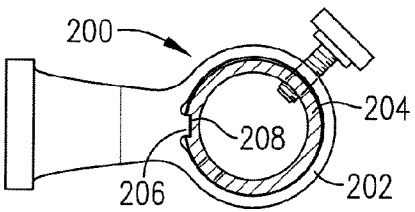
FIG. 20 is sectional view of the frame assembly taken substantially along line 20-20 of FIG. 19.

As previously indicated, the adjustability of the workpiece-supporting tool assembly 16 relative to the frame assembly 14 can be accomplished in a variety of alternative manners. One such alternative configuration is the fixture 200 illustrated in FIGS. 19 and 20. The fixture 200 is similarly in many respects to the previously described fixture 36 and is configured for positioning on the distal end of the tool assembly arm 34 to removably and adjustably receive the workpiece-supporting tool assembly 16. Accordingly, only the differences in the fixture 200 will be described in detail herein. The fixture 200 includes a neck 202 and a collar 204, however, the collar 204 is not threadably received in the neck 202, but rather is slidably received therein. The neck 202 includes a key 206 and the collar 204 includes a complemental keyway 208 for engagement with the key 206 to prevent rotation of the collar 204 relative to the neck 202. Unlike the fixture 36 previously described, the fixture 200 includes two locking rings threadably received on the collar 204, a top locking ring 210 position above the neck 202, and a bottom locking ring 212 positioned below the neck 202. In this manner, the collar can be quickly and easily adjusted for precise and secure positioning relative to the neck 202.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A handheld tool assembly for supporting a workpiece, said tool assembly comprising:

a housing configured and dimensioned to be hand held, said housing presenting a holder-receiving chamber;

a workpiece holder removably received in the chamber and operable to support the workpiece; and a connection assembly operable to removably and adjustably couple the holder and the housing, said connection assembly including a shaft and a nut, at least a portion of said shaft being removably and threadably received within the nut so that threading of the shaft into the nut adjusts the holder relative to the housing, said nut being releasably and rotatably captive on the housing with at least a portion of said nut being connected to and rotatable independently of the housing while remaining connected to the housing when the shaft is removed from the nut, said housing presenting opposite first and second ends, said holder being recievedin the first end, said housing including an annular slot formed adjacent the second end, said annular slot extending generally transverse relative to said internal chamber and extending entirely through at least a portion of the housing so as to communicate with the atmosphere, said slot being spaced from said second end to define a lip there between, said lip including an opening formed therein in communication with the atmosphere.

2. The tool assembly as claimed in claim 1, said nut presenting a top and a bottom, said nut including a flange formed in the top and configured to be slidably received in said slot for rotation therein.

3. The tool assembly as claimed in claim 1, said nut presenting a top and a bottom and a circumferential outer surface extending there between, said nut including a circumferentially recessed neck formed adjacent the top and spaced therefrom to define a flange there between, said neck being configured to be received through said opening, said flange being configured to be slidably received in said slot for rotatable support on said lip.

4. The tool assembly as claimed in claim 1, said chamber including upper and lower sections, said upper section presenting a first inner diameter and said lower section presenting a second inner diameter smaller than the first diameter so as to define an annular ledge between the upper and lower sections.

5. The tool assembly as claimed in claim 4, said shaft slidable into and out of a threading position wherein the shaft extends into the slot formed in the second end of the housing.

6. The tool assembly as claimed in claim 5, said shaft including a key extending transversely therefrom, said lower section including a keyway formed therein and being sized and configured to slidably receive the key, said keyway extending generally transverse relative to said annular slot, said key engaging the ledge to hold the shaft out of the threading position and positionable into the keyway to permit the shaft to slide into the threading position.

7. The tool assembly as claimed in claim 1, said connection assembly including a latch pin coupled to the workpiece holder and extending transversely therefrom, said connection assembly further including a receiver configured to removably receive the latch pin.

8. The tool assembly as claimed in claim 7, said receiver including the shaft and further including a boss coupled above the shaft, said boss presenting a first outer diameter and said shaft presenting a second outer diameter smaller than the first outer diameter.

9. The tool assembly as claimed in claim 8, said boss presenting a central recess in communication with the holder-receiving chamber, said boss further including oppositely spaced helical slot sections formed therein each being configured to receive the latch pin.

10. The tool assembly as claimed in claim 9, each of said slot sections defining a lower-most point and diverging upwardly therefrom, said latch pin being rotatably slidable along said slot sections into and out of an engagement position wherein the pin is trapped in the slot sections past the lower-most points.

11. The tool assembly as claimed in claim 10, said connection assembly further including a spring received in the recess to bias the latch pin into the engagement position when the latch pin is on one side of the lower-most points and to bias the latch pin out of the engagement position when the latch pin is on another side of the lower-most points.

12. The tool assembly as claimed in claim 1, said connection assembly including a latch pin coupled to the workpiece holder and extending transversely therefrom, said connection assembly farther including a receiver configured to removably receive the latch pin.

13. A handheld tool assembly for supporting a workpiece, said tool assembly comprising:

a housing configured and dimensioned to be hand held, said housing presenting a holder-receiving chamber;

a workpiece holder removably received in the chamber and operable to support the workpiece; and a connection assembly operable to removably and adjustably couple the holder and the housing, said connection assembly including a shaft and a nut, at least a portion of said shaft being removably and threadably received within the nut so that threading of the shaft into the nut adjusts the holder relative to the housing, at least a portion of said nut being connected to and rotatable independently of the housing when the shaft is removed from the nut, said housing presenting opposite first and second ends, said holder being received in the first end, said housing including an annular slot formed adjacent the second end, said annular slot extending generally transverse relative to said internal chamber and extending entirely through at least a portion of the housing so as to communicate with the atmosphere, said slot being spaced from said second end to define a lip there between, said lip including an opening formed therein in communication with the atmosphere.

14. The tool assembly as claimed in claim 13, said nut presenting a top and a bottom, said nut including a flange formed in the top and configured to be slidably received in said slot for rotation therein.

15. The tool assembly as claimed in claim 13, said nut presenting a top and a bottom and a circumferential outer surface extending there between, said nut including a circumferentially recessed neck formed adjacent the top and spaced therefrom to define a flange there between, said neck being configured to be received through said opening, said flange being configured to be slidably received in said slot for rotatable support on said lip.

16. The tool assembly as claimed in claim 13, said chamber including upper and lower sections, said upper section presenting a first inner diameter and said lower section presenting a second inner diameter smaller than the first diameter so as to define an annular ledge between the upper and lower sections.

17. The tool assembly as claimed in claim 16, said shaft slidable into and out of a threading position wherein the shaft extends into the slot formed in the second end of the housing.

18. The tool assembly as claimed in claim 17, said shaft including a key extending transversely therefrom, said lower section including a keyway formed therein and being sized and configured to slidably receive the key, said keyway extending generally transverse relative to said annular slot, said key engaging the ledge to hold the shaft out of the threading position and positionable into the keyway to permit the shaft to slide into the threading position.

* * * * *